US008292083B2

(12) United States Patent
Varghese et al.

(10) Patent No.: US 8,292,083 B2
(45) Date of Patent: Oct. 23, 2012

(54) METHOD AND APPARATUS FOR SEPARATING PARTICLES, CELLS, MOLECULES AND PARTICULATES

(75) Inventors: Mathew Varghese, Arlington, MA (US); Jason O. Fiering, Boston, MA (US); Donald E. Ingber, Boston, MA (US); Nan Xia, San Jose, CA (US); Mark J. Mescher, West Newton, MA (US); Jeffrey T. Borenstein, Newton, MA (US); Chong Wing Yung, Boston, MA (US)

(73) Assignees: The Charles Stark Draper Laboratory, Inc., Cambridge, MA (US); Children's Medical Center Corporation, Boston, MA (US)

( * ) Notice: Subject to any disclaimer, the term of this patent is extended or adjusted under 35 U.S.C. 154(b) by 615 days.

(21) Appl. No.: 12/105,805

(22) Filed: Apr. 18, 2008

(65) Prior Publication Data

US 2009/0078614 A1 Mar. 26, 2009

Related U.S. Application Data

(60) Provisional application No. 60/925,355, filed on Apr. 19, 2007.

(51) Int. Cl.
*B03C 1/30* (2006.01)

(52) U.S. Cl. ..... 209/39; 209/215; 436/164; 436/180; 436/518; 435/4; 435/6

(58) Field of Classification Search ..... 209/39; 204/450, 451, 452, 454, 456
See application file for complete search history.

(56) References Cited

U.S. PATENT DOCUMENTS

| | | | |
|---|---|---|---|
| 1,583,051 | A | 5/1926 | Kennedy |
| 2,608,390 | A | 8/1952 | Philippe |
| 3,127,738 | A | 4/1964 | Hasbrouck et al. |
| 3,128,794 | A | 4/1964 | Donald et al. |
| 3,342,378 | A | 9/1967 | Mezoff et al. |
| 3,421,739 | A | 1/1969 | Alberts et al. |
| 3,470,912 | A | 10/1969 | Bydal |
| 3,506,244 | A | 4/1970 | Strang |
| 3,507,301 | A | 4/1970 | Larson |
| 3,510,240 | A | 5/1970 | Rhinehart |
| 3,847,773 | A | 11/1974 | Snyder |
| 3,852,013 | A | 12/1974 | Upmeier |
| 3,963,221 | A | 6/1976 | Yi |

(Continued)

FOREIGN PATENT DOCUMENTS

DE 3624626 A1 1/1988

(Continued)

OTHER PUBLICATIONS

Chen et al. "Topologic Mixing on a Microfluidic Chip." App. Phys. Ltrs. 84:12, 2193-95. (2004).

(Continued)

*Primary Examiner* — Terrell Matthews
(74) *Attorney, Agent, or Firm* — Edward A. Gordon; Foley and Lardner LLP

(57) ABSTRACT

A method and apparatus for continuously separating or concentrating particles that includes flowing two fluids in laminar flow through a magnetic field gradient which causes target particles to migrate to a waste fluid stream, and collecting each fluid stream after being flowed through the magnetic field gradient.

30 Claims, 12 Drawing Sheets

U.S. PATENT DOCUMENTS

| | | | | |
|---|---|---|---|---|
| 4,214,610 | A | 7/1980 | James et al. | |
| 4,222,671 | A | 9/1980 | Gilmore | |
| 4,285,602 | A | 8/1981 | Hagerty et al. | |
| 4,426,344 | A | 1/1984 | Dinter et al. | |
| 4,465,582 | A | 8/1984 | Richman | |
| 4,473,300 | A | 9/1984 | Goins | |
| 4,518,260 | A | 5/1985 | Goins | |
| 4,553,849 | A | 11/1985 | Goins | |
| 4,948,481 | A | 8/1990 | Mullner et al. | |
| 4,983,038 | A | 1/1991 | Ohki et al. | |
| 5,094,788 | A | 3/1992 | Schrenk et al. | |
| 5,180,480 | A | 1/1993 | Manz | |
| 5,185,071 | A | 2/1993 | Serwer et al. | |
| 5,250,188 | A | 10/1993 | Bruening et al. | |
| 5,269,995 | A | 12/1993 | Ramanathan et al. | |
| 5,275,706 | A | 1/1994 | Weber et al. | |
| 5,518,311 | A | 5/1996 | Althaus et al. | |
| 5,531,831 | A | 7/1996 | Sweeney et al. | |
| 5,620,714 | A | 4/1997 | Veen | |
| 5,765,373 | A | 6/1998 | Bittle et al. | |
| 5,780,067 | A | 7/1998 | Herrington, Jr. | |
| 5,803,600 | A | 9/1998 | Schubert et al. | |
| 5,816,045 | A | 10/1998 | Blocker et al. | |
| 5,824,204 | A | 10/1998 | Jerman | |
| 5,826,981 | A | 10/1998 | Fowler et al. | |
| 5,904,424 | A | 5/1999 | Schwesinger et al. | |
| 5,932,100 | A | 8/1999 | Yager et al. | |
| 6,082,891 | A | 7/2000 | Schubert et al. | |
| 6,136,171 | A | 10/2000 | Frazier et al. | |
| 6,136,272 | A | 10/2000 | Weigl et al. | |
| 6,143,152 | A | 11/2000 | Simpson et al. | |
| 6,190,034 | B1 | 2/2001 | Nielsen et al. | |
| 6,221,677 | B1 | 4/2001 | Wu et al. | |
| 6,225,497 | B1 | 5/2001 | Becker et al. | |
| 6,264,900 | B1 | 7/2001 | Schubert et al. | |
| 6,299,657 | B1 | 10/2001 | Schubert et al. | |
| 6,321,998 | B1 | 11/2001 | Schubert et al. | |
| 6,328,868 | B1 | 12/2001 | Weber et al. | |
| 6,387,707 | B1 | 5/2002 | Seul et al. | |
| 6,432,630 | B1 * | 8/2002 | Blankenstein | 435/4 |
| 6,454,945 | B1 | 9/2002 | Weigl et al. | |
| 6,467,503 | B2 | 10/2002 | Schlesch et al. | |
| 6,479,734 | B2 | 11/2002 | Iba et al. | |
| 6,623,860 | B2 | 9/2003 | Hu et al. | |
| 6,676,835 | B2 | 1/2004 | O'Connor et al. | |
| 6,692,627 | B1 | 2/2004 | Russell et al. | |
| 6,695,147 | B1 | 2/2004 | Yager et al. | |
| 6,705,357 | B2 | 3/2004 | Jeon et al. | |
| 6,802,640 | B2 | 10/2004 | Schubert et al. | |
| 6,845,787 | B2 | 1/2005 | Karp et al. | |
| 6,851,846 | B2 | 2/2005 | Fujii et al. | |
| 6,877,892 | B2 | 4/2005 | Karp | |
| 6,890,093 | B2 | 5/2005 | Karp et al. | |
| 6,905,324 | B2 | 6/2005 | Cloeren | |
| 6,923,907 | B2 | 8/2005 | Hobbs et al. | |
| 6,935,772 | B2 | 8/2005 | Karp et al. | |
| 6,958,245 | B2 | 10/2005 | Seul et al. | |
| 6,981,522 | B2 | 1/2006 | O'Connor et al. | |
| 7,005,050 | B2 | 2/2006 | Burns et al. | |
| 7,033,473 | B2 | 4/2006 | Gascoyne et al. | |
| 7,056,746 | B2 | 6/2006 | Seul et al. | |
| 7,077,906 | B2 | 7/2006 | Colombo et al. | |
| 7,100,636 | B2 | 9/2006 | King | |
| 7,135,144 | B2 | 11/2006 | Christel et al. | |
| 7,138,269 | B2 * | 11/2006 | Blankenstein | 435/287.2 |
| 7,258,774 | B2 * | 8/2007 | Chou et al. | 204/450 |
| 7,261,812 | B1 | 8/2007 | Karp et al. | |
| 7,316,503 | B2 | 1/2008 | Mathys et al. | |
| 7,472,794 | B2 * | 1/2009 | Oakey et al. | 210/420 |
| 7,487,799 | B2 | 2/2009 | Wobben | |
| 7,520,661 | B1 | 4/2009 | Lawson | |
| 7,632,405 | B2 * | 12/2009 | Siddiqi | 210/222 |
| 7,699,767 | B2 * | 4/2010 | Mueth et al. | 494/36 |
| 2002/0045738 | A1 | 4/2002 | Singh et al. | |
| 2002/0057627 | A1 | 5/2002 | Schubert et al. | |
| 2002/0187503 | A1 * | 12/2002 | Harrold et al. | 435/6 |
| 2003/0057092 | A1 | 3/2003 | Chien et al. | |
| 2004/0092033 | A1 * | 5/2004 | Gustafson et al. | 436/180 |
| 2004/0182707 | A1 | 9/2004 | Jardemark et al. | |
| 2004/0256230 | A1 | 12/2004 | Yager et al. | |
| 2004/0257907 | A1 | 12/2004 | Xu et al. | |
| 2005/0061669 | A1 | 3/2005 | Woudenberg et al. | |
| 2005/0178701 | A1 | 8/2005 | Roth et al. | |
| 2008/0067068 | A1 * | 3/2008 | Li | 204/451 |
| 2008/0237044 | A1 * | 10/2008 | Fiering et al. | 204/549 |
| 2009/0044619 | A1 | 2/2009 | Fiering et al. | |
| 2009/0078614 | A1 * | 3/2009 | Varghese et al. | 209/39 |
| 2009/0086572 | A1 | 4/2009 | Miyoshi et al. | |

FOREIGN PATENT DOCUMENTS

| | | |
|---|---|---|
| DE | 3926466 | 2/1991 |
| DE | 19748481 | 5/1999 |
| EP | 0 434 556 A1 | 6/1991 |
| EP | 1 742 057 | 1/2007 |
| WO | WO-96/26782 | 9/1996 |
| WO | WO-01/87458 | 11/2001 |
| WO | WO-2009/023507 | 2/2009 |

OTHER PUBLICATIONS

Fiering et al. "Continuous High-Throughput Magnetic Separation of Pathogens from Blood." Micro-Fluidic Components and Systems, 0345. (2008).

Irmia et al. "Universal Microfluidic Gradient Generator." Anal. Chem. 78, 3472-77. (2006).

Ismagilov et al. "Pressure-Driven Laminar Flow in Tangenetial Microchannels: an Elastomeric Microfluidic Switch." Anal. Chem. (2001).

Wang et al. "An Overlapping Crisscross Micromixer Using Chaotic Mixing Principles." J. Micromech. Microeng. 16, 2684-91. (2006).

Xia et al. "Chaotic Micromixers Using Two-Layer Crossing Channels to Exhibit Fast Mixing at Low Reynolds Numbers." Royal Soc. of Chem., Lab Chip, 5, 748-55. (2005).

Welte et al. Structure and Function of the Porin Channel. Kidney International, 48:930-40. (1995).

Albrecht et al. Rapid Free Flow Isoelectric Focusing via Novel Electrode Structures. 9th Intl. Conf. on Miniaturized Systems for Chemistry and Life Sciences (MicroTAS). (2005).

Biscans et al. Influence on flow and diffusion on protein separation in a continuous flow electrophoresis cell: Computation procedure. Electrophoresis, 9:84-89 (1988).

Blankenstein "Microfabricated Flow system for magnetic cell and particle separation" Scientific and Clinical Applications of magnetic carriers. 1997, Chapter 16. pp. 223-245.

Chien, R.L. Sample stacking revisited: A personal perspective. Electrophoresis, 24:486-97 (2003).

Clifton et al. Conditions for purification proteins by free-flow zone electrophoresis. Electrophoresis, 11:913-19 (1990).

Edwards et al. A Microfabricated Thermal Field-Flow Fractionation System. Anal. Chem. 74:6, 2322-26 (2002).

Gale et al. A Micromachined Electrical Field-Flow Fractionation (1.1-EFFF) System. IEEE Transactions on Biomedical Engineering. 45:12(1459-69 (Dec. 1998).

Hoffman et al. Continuous free-flow electrophoresis separation of cytosolic proteins from the human colon carcinoma cell line LIM 1215: A non two-dimensional gel electrophoresis-based proteome analysis strategy. Proteomics, 1:807-18 (2001).

Huang et al. On-line isotachophoretic preconcentration and gel electrophoretic separation on sodium dodecyl sulfate-proteins on a microchip. Electrophoresis, 26:2254-60 (2005).

Huber et al. Programmed Adsorption and Release of Proteins in a Microfluidic Device. Science. 301:352-54 (Jul. 18, 2003).

Jacobson et al. Microchip electrophoresis with sample stacking. Electrophoresis, 16:481-86 (1995).

Janasek et al. Electrostatic induction of the electric field into free-flow electrophoresis devices. Lab Chip, 6:710-13 (2006).

Jung et al. Thousandfold signal increase using field-amplified sample stacking for on-chip eletrophoresis. Electrophoresis 2003. 24:3476-83 (2003).

Kamholz et al. Quantitative Analysis of Molecular Interaction in a Microfluidic Channel: The T-Sensor. Anal. Chem., 71:5340-47 (1999).

Kohlheyer et al. Free-flow zone electrophoresis and isoelectric focusing using a microfabricated glass device with ion permeable membranes. Lab Chip, 6:374-80 (2006).
Krivankova et al. Continuous free-flow electrophoresis. Electrophoresis, 19:1064-74 (1998).
Lao et al. Miniaturized Flow Fractionation Device Assisted by a Pulsed Electric Field for Nanoparticle Separation. Anal. Chem. 74:20, 5364-69 (2002).
Li et al. Rapid and sensitive separation of trace level protein digests using microfabricated devices coupled to a quadrupole time-of-flight mass spectrometer. Electrophoresis 2000. 21:198-210 (2000).
Millipore. Urine Concentration with Amicon Ultra Centrifugal Filters. Downloaded from http://www.millipore.com/publications.nsf/docs/6djsf9. (2005).
Osbourn et al. On-line preconcentration methods for capillary electrophoresis. Electrophoresis, 21:2768-79 (2000).
Quirino et al. Approaching a Million-Fold Sensitivity Increase in Capillary Electrophoresis with Direct Ultraviolet Detection: Cation-Selective Exhaustive Injection and Sweeping. Anal. Chem., 72:1023-30 (2000).
Raymond et al. Continuous Sample Preparation Using Free-Flow Electrophoresis on a Silicon Microstructure. Transducers '95, Eurosensors IX, The 8th International Conference on Solid-State Sensors and Actuators, and Eurosensors IX, Stockholm, Sweden, Jun. 25-29, 1995, pp. 760-763.
Reyes et al. Micro Total Analysis Systems. 1. Introduction, Theory, and Technology. Anal. Chem., 74:2623-36 (2002).
Ross et al. Microfluidic Temperature Gradient Focusing. Anal. Chem., 74:2556-64 (2002).
Song et al. Electrophoretic Concentration of Proteins at Laser-Patterned Nanoporous Membranes in Microchips. Anal. Chem., 76:4589-92 (2004).
Wainright et al. Sample pre-concentration by isotachophoresis in microfluidic devices. Journal of Chromatography A, 979:69-80 (2002).
Wang et al. Million-fold Preconcentration of Proteins and Peptides by Nanofluidic Filter. Anal. Chem., 77:4293-99 (2005).
Wang et al. Two-Dimensional Protein Separation with Advanced Sample and Buffer Isolation Using Microfluidic Valves. Anal. Chem., 76:4426-31 (2004).
Zhang et al. High-Speed Free-Flow Electrophoresis on Chip. Anal. Chem., 75:5759-66 (2003).
Raymond et al. Continuous Sample Pretreatment Using a Free-Flow Electrophoresis Device Integrated onto a Silicon Chip. Anal. Chem., 66:2858-65 (1994).
Song et al. Continuous-Flow pI-Based Sorting of Proteins and Peptides in a Microfluidic Chip Using Diffusion Potential. Anal. Chem. 78:11, 3528-36. (2006).

* cited by examiner

METHOD AND APPARATUS FOR SEPARATING PARTICLES, CELLS, MOLECULES AND PARTICULATES

CROSS-REFERENCE TO RELATED APPLICATION

This application claims the benefit of U.S. Provisional Application Ser. No. 60/925,355, filed Apr. 19, 2007, the entire contents of which are incorporated herein by reference

FIELD OF INVENTION

This invention relates to liquid phase separation and/or concentration of particles, cells, or particles in solution. In particular, it relates to separation or concentration from flowing liquids. It provides a means to simply and rapidly extract target objects from complex mixtures. Such devices are useful in systems for, e.g., medical therapy (similar to dialysis), but also for detection, purification, and synthesis. A specific embodiment is in the magnetic separation of pathogens from infected blood.

BACKGROUND OF THE INVENTION

Chemical and biological separation and concentration has historically included methods such as solid-phase extraction, filtration chromatography, flow cytometry and others. Known methods of magnetic separation in biological fields include aggregation in batches, capture on magnetized surfaces, and particle deflection (or "steering") in single-channel devices. Typically, the particle of interest is chemically bound to magnetic microparticles or nanoparticles.

Existing methods are typically batch processes rather than continuous free-flow processes. This limits their usefulness in in-line systems. Moreover, existing methods typically operate at the macroscale, where diffusion distances require slower flow speeds, resulting in limited throughput. This problem is compounded in single-channel devices. The present invention improves on known methods and apparatuses for magnetic separation of particles from a fluid by providing a continuous, free-flow, higher throughput separation.

SUMMARY OF THE INVENTION

The present invention includes systems, methods, and other means for separating molecules, cells, or particles from liquids, including aqueous solutions. The present invention may utilize a flow cell with a plurality of microfluidic separation channels. The present invention may utilize a magnetic housing to provide a magnetic field gradient across each of the microfluidic separation channels to separate particles, cells, or molecules from an aqueous solution. In one aspect, the present invention relates to a flow cell for separating or concentrating particles.

In some embodiments of the present invention, the flow cell has an upstream end and a downstream end. The flow cell includes a plurality of separation channels. The plurality of separation channels, in one embodiment, are array perpendicularly with respect to both fluid flow through the channels and the predominant direction of the magnetic field gradient applied across the channels. At the upstream end, the flow cell includes two input ports. One input port introduces into the channel a fluid stream containing a target particle, cell, or molecule, and potentially other particles, cells, or molecules. The other input port introduces into the flow channel another fluid stream. The channel includes two output ports. One output port receives most of the first fluid stream. The second output port receives most of the second fluid stream and most of the target particles from the first stream.

In one embodiment, the flow cell can be a removable insert that can be placed into a magnetic housing. In one embodiment, the flow cell can be disposable. Because the flow cell contains no magnetic parts, it can be manufactured simply and at low cost.

In another aspect, the invention relates to a magnetic housing for applying a magnetic field gradient across each of the separation channels of the flow cell. The magnetic housing includes a stage for positioning a flow cell. The magnetic housing also includes at least one plate for applying a magnetic field gradient across each of the separation channels in the flow cell. The magnetic housing also includes a magnetic source. The magnetic source is the source of the magnetic field gradient created between the stage and the plate.

In some embodiments, the stage can be positioned for inserting or removing a flow cell. Such an embodiment can be used in conjunction with the removable flow cell as described herein. Such an embodiment can also be used in conjunction with a removable disposable flow cell as described herein. In some embodiments, the surface of the stage is flat. In other embodiments, the surface of the stage is shaped to change the shape of the magnetic field gradient. The stage can be made of any permeable metal, but is preferably made of high-permeability metal.

In some embodiments, the surface of the plate has a shape selected to concentrate the magnetic field gradient across each of the separation channels. For example the surface of the plate may includes rectangular, rounded, or prismatic protrusions spaced to align with respective separation channels.

In some embodiments, the magnetic source is a permanent magnet. In other embodiments, the magnetic source is an electromagnet.

In some embodiments, the magnetic housing can be shaped like the letter "C". In other embodiments, the magnetic housing can be composed of two plates in parallel. In either embodiment, the magnetic field gradient may be generated by a permanent magnet or an electromagnet.

In another aspect, the invention relates to a method for separating or concentrating particles. The method includes flowing the first fluid containing target particles into the flow cell, flowing the second fluid into the flow cell such that the first and second fluids are in laminar flow in the separation channels, applying the magnetic field gradient with appropriate polarity and strength to cause target particles to diffuse from the first fluid into the second fluid, combining the first fluid streams from each of the separation channels into a first output stream, and combining the second fluid streams from each of the separation channels into a second output stream.

BRIEF DESCRIPTION OF THE FIGURES

The foregoing discussion will be understood more readily from the following detailed description of the invention with reference to the following drawings.

DESCRIPTION OF CERTAIN ILLUSTRATIVE EMBODIMENTS

Figure 1:
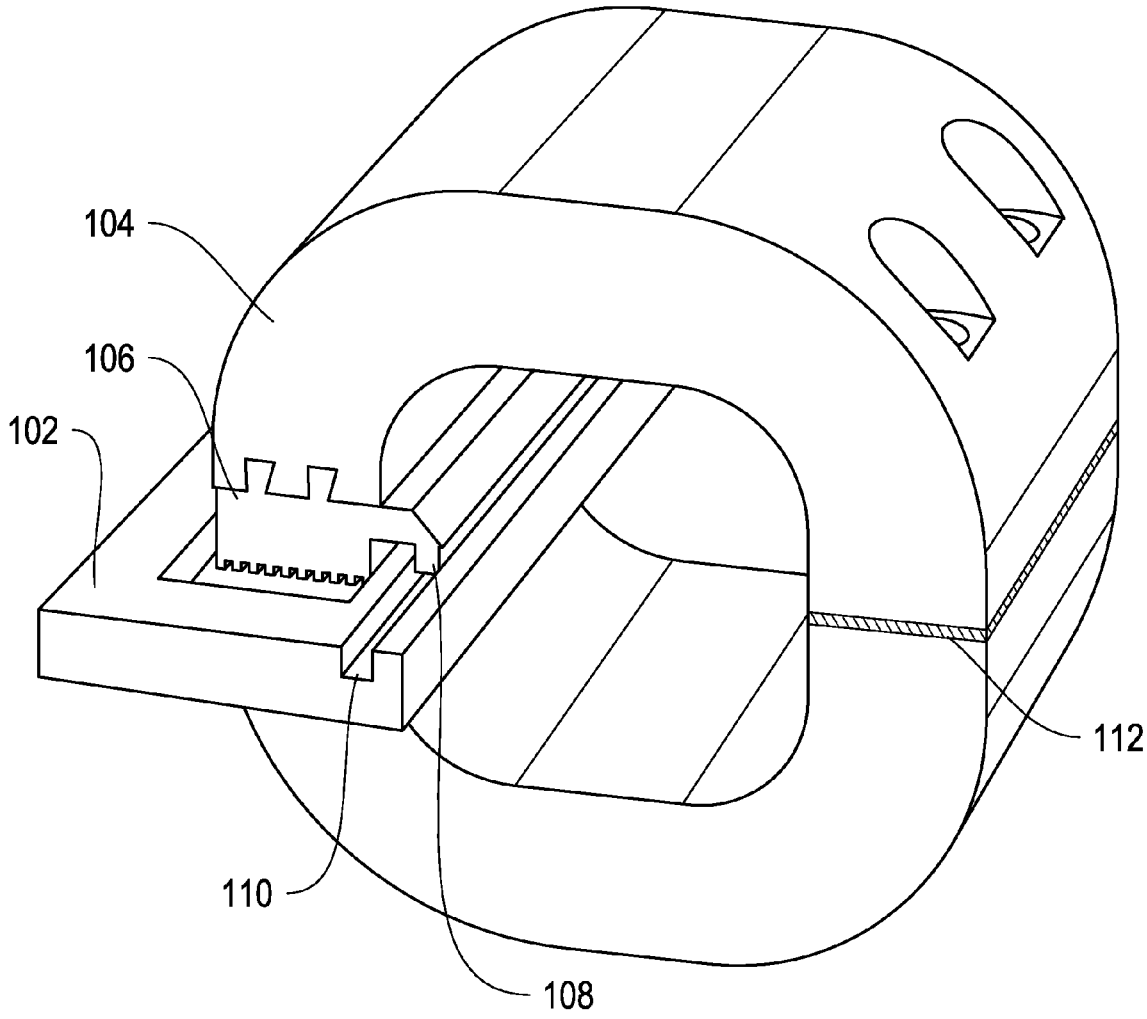
FIG. 1 is a CAD drawing illustrating one embodiment of a flow cell positioned in a magnetic housing.

FIG. 1 is a CAD drawing illustrating one embodiment of a flow cell 102 positioned in a magnetic housing 104. Flow cell 102 is a removable device which is positioned in the magnetic housing 104 by means of a plate 106. Plate 106 can be removable from magnetic housing 104. In some embodiments, magnetic housing 104 may be used with a variety of interchangeable plates. Different plates may have different surface shapes facing flow cell 102. The different surface shapes will result in different magnetic field gradients across the flow cell 102. A particular magnetic field gradient may be desired for a particular application. The desired magnetic field gradient may be selected by selecting a plate with a particular shape. In this embodiment, plate 106 is depicted with a square, ridged surface facing flow cell 102. In other embodiments, the surface of plate 106 may be any of a variety of shapes suited to generate a magnetic field gradient across flow cell 102, such as any of the shapes described in FIGS. 9A-9H, below.

Plate 106 is aligned with flow cell 102 such that the surface of plate 106 is positioned appropriately relative to the separation channels (not visible in this diagram) of flow cell 102. In order to properly align plate 106 and flow cell 102, a "tongue-and-groove" technique can be used, wherein tongue 108 of plate 106 is aligned with groove 110 of flow cell 102 to ensure that the parts are properly positioned relative to each other.

In one embodiment, magnetic housing 104 can be a permanent magnet. The strength of the magnetic field gradient across flow cell 102 may be adjusted by increasing or decreasing the proximity of plate 106 to flow cell 102. Variable shim 112 can be used to adjust the "air gap" between plate 106 and flow cell 102.

Figure 2:
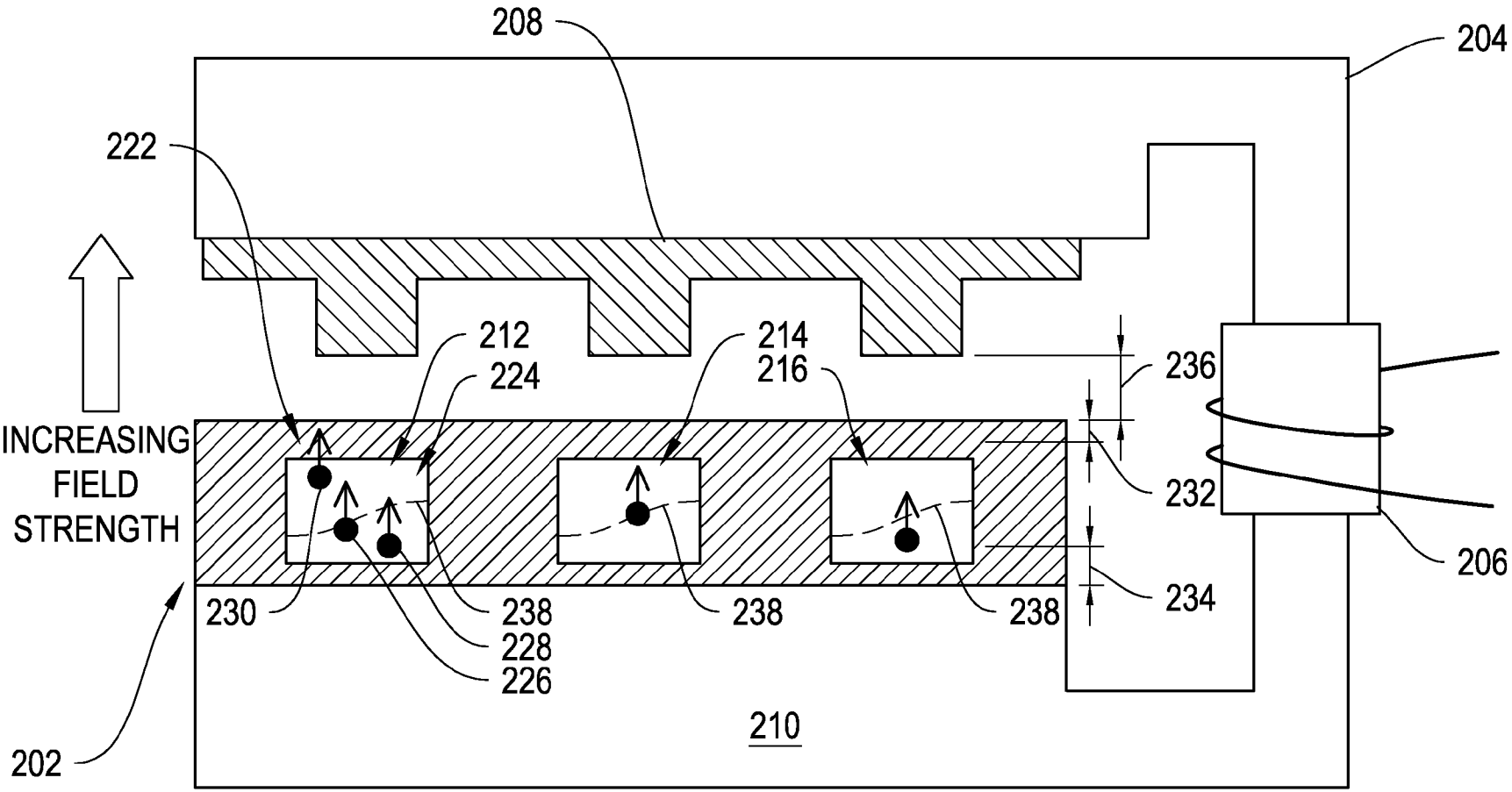
FIG. 2 is a schematic diagram illustrating a cross-section of one embodiment of a flow cell positioned in a magnetic housing.

In other embodiments, such as the embodiment depicted in FIG. 2, magnetic housing 104 can be an electromagnet. In such an embodiment, magnetic housing 104 is high-permeability metal and includes windings around magnetic housing 104 for carrying an electric current. When electric current is flowed through the windings, a magnetic field gradient is generated across flow cell 102. The strength of the magnetic field gradient across flow cell 102 can be adjusted by increasing or decreasing the current flow through the windings.

FIG. 2 is a schematic diagram illustrating a cross-section of one embodiment of a flow cell 202 positioned in a magnetic housing 204. Magnetic housing 204 includes a magnetic source 206. Magnetic source 206 is depicted as an electromagnet. The remainder of magnetic housing 204 is high-permeability metal. In other embodiments, magnetic source 206 can be a permanent magnet. Magnetic housing 204 also includes a plate 208 and a stage 210. Plate 208 is depicted having three rectangular ridges running lengthwise above separation channels 212, 214, and 216. This surface geometry enhances the field gradient across separation channels 212, 214, and 216. Other surface geometries may also be suitable, such as any of the surface geometries described below, with respect to FIGS. 9A-9H. Plate 208 and stage 210 focus the magnetic field gradient from magnetic source 206 at the separation channels 212, 214, and 216 of flow cell 202.

The operation of separation channels 212, 214, and 216 is explained with reference to separation channel 212. Sample fluid stream 222 is shown at the top of separation channel 212. Buffer fluid stream 224 is shown at the bottom of separation channel 212. Interface 238 between the sample fluid stream 222 and buffer fluid stream 224 may have a sigmoidal shape due to transverse fluid-mechanical interactions at interface 238 caused by bringing the two fluid streams 222 and 224 into laminar flow at an angle, as described later with regard to FIG. 5. Sample fluid stream 222 contains particles, for example particles 226 and 228. The arrows indicate that they are subject to the magnetic force in the direction of buffer fluid stream 224. Buffer fluid 224 contains target particle 230. In operation, a target particle, for example target particle 230, would have entered separation channel 212 as part of sample fluid stream 222. As the pressure-driven flow of sample fluid stream 222 carried target particle 230 through separation channel 212, target particle 230 would have been subject to a magnetic field gradient created by magnetic housing 204, particularly by plate 208 and stage 210, causing it to move into buffer fluid stream 224. At the instant in time depicted in FIG. 2, the magnetic field gradient across separation channel 212 has caused target particle 230 to move into buffer fluid stream 224. The magnetic field gradient will keep target particle 230 in buffer fluid stream 224 as the pressure-driven flow of buffer fluid stream 224 carries target particle 230 to the end of separation channel 212 and through a first outlet for buffer fluid stream 224. Target particle 230 is thereby removed from sample fluid stream 222 which, at the end of the separation channel, flows through a second outlet for sample fluid stream 222.

Target particle 230 can be any type of particle. For example, target particle 230 can be any of a molecule, cell, spore, protein, virus, bacteria, or other particle.

Separation channels 212, 214, and 216 can be about 200 to 300 μm wide, 50 to 200 μm tall, and 1 to 10 cm long. For example, separation channels 212, 214, and 216 may be 250 μm wide×100 μm high, and spaced on a pitch of 500 μm. With those dimensions, a flow rate of 3 ml/min throughput can be achieved in a device area of 10×10 cm. Flow rate can be increased by using a flow cell with more separation channels. Although flow cell 202 is depicted with only three separation channels, a flow cell of the present invention could incorporate many more separation channels, for example 200 separation channels.

Layers 232 and 234 of flow cell 202 form the top and bottom of flow channels 212, 214, and 216, respectively. The distance between the top of separation channels 212, 214, and 216, and the top of flow cell 202 is determined, in party, by the thickness of layer 232. The distance between the bottom of separation channels 212, 214, and 216, and the bottom of the flow cell 202 is determined, in party, by the thickness of layer 234. Because the magnetic field gradient is a function of distance between the separation channels and plate 208, and between the separation channels, and stage 210, the thickness of layers 232 and 234 may be altered in some embodiments in order to adjust magnetic field gradient strength across separation channels 212, 214, and 216. The channels can be brought within 300 μm of the magnets, achieving a highly parallel array with field strengths and gradients comparable to those demonstrated in a single channel. For example, in some embodiments, the thickness of layers 232 and 234 may be between 200 μm and 300 μm, such as 250 μm. The magnetic field gradient strength may also be adjusted in other ways. In some embodiments, air gap 236 between flow cell 202 and plate 208 and stage 210 may be altered in order to adjust magnetic field gradient strength across separation channels 212, 214, and 216.

In some embodiments, the walls of separation channels 212, 214, and 216 may be treated to improve bio-compatibility. For example, a flow cell fabricated using Polydimethylsiloxane (PDMS) may be plasma treated to improve the biocompatibility of the PDMS.

In some embodiments, the walls of separation channels 212, 214, 216 may be coated with a bio-compatible coating in order to reduce surface interactions between the walls of the separation channels and the sample fluid stream or any target particles therein. For example, the walls of separation channels 212, 214, and 216 may be coated with Parylene.

Figure 3:
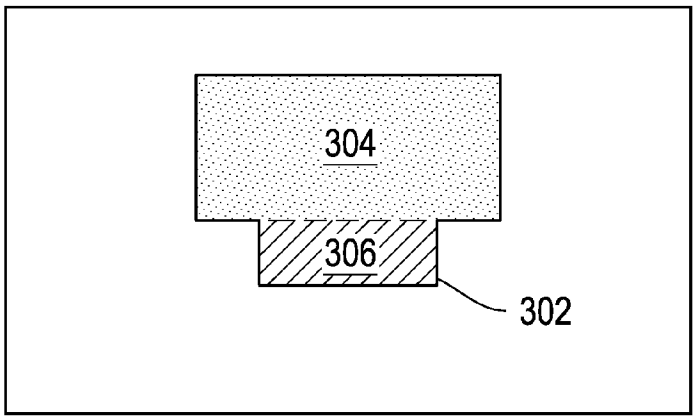
FIG. 3 is a schematic diagram illustrating an embodiment of a flow cell in which separation channel has a non-uniform width.

FIG. 3 is a schematic diagram illustrating an embodiment of a flow cell in which separation channel 302 has a non-uniform width. As shown, the width of the channel in the region through which sample fluid stream 304 flows is the greater than the width of the channel in the region through which buffer fluid stream 306 flows.

Figure 4:
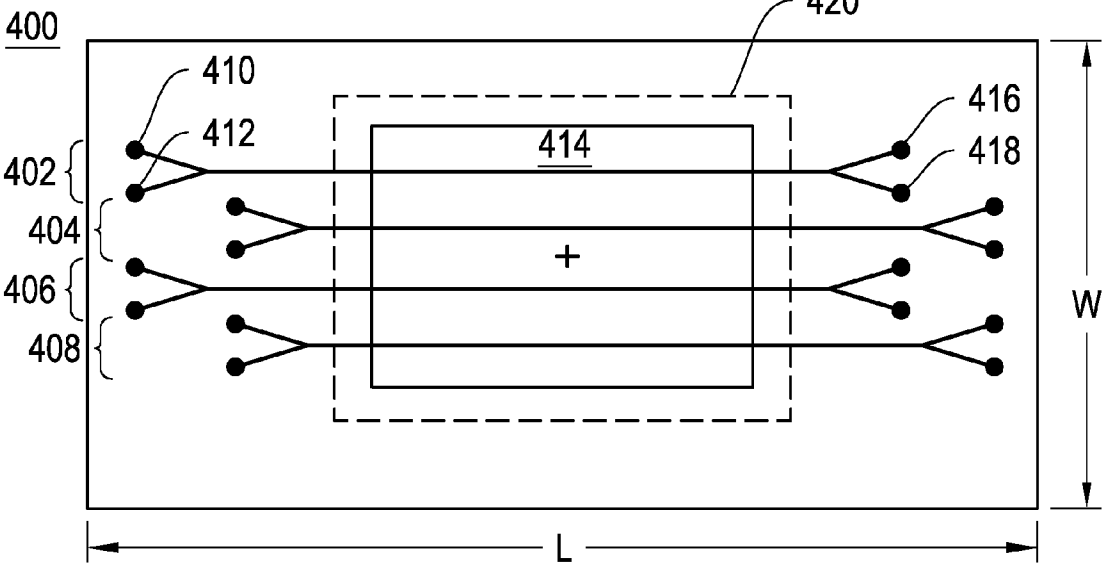
FIG. 4 is a schematic diagram of the top view of a flow cell.

FIG. 4 is a schematic diagram of the top view of a flow cell 400. Flow cell 400 includes four separation channels 402, 404, 406, and 408. Separation channel 402 includes a buffer fluid stream inlet 410, a sample fluid stream inlet 412, a channel 414, a buffer fluid stream outlet 416, and a sample fluid stream outlet 418. Like separation channel 402, separation channels 404, 406, and 408 also include buffer fluid stream inlets, sample fluid stream inlets, channels, buffer fluid stream outlets, and sample fluid stream outlets. Each of separation channels 402, 404, 406, and 408 may be staggered with respect to its neighbors, as depicted, in order to provide space for their respective inlets and outlets. By staggering the inlets and outlets, flow cell 400 may accommodate more separation channels in any given width. Flow cell 102 of FIG. 1 provides an alternative illustration of area 420 of flow cell 400 in FIG. 4.

Flow cell 400 also includes area 420 over the channels of separation channels 402, 404, 406, and 408. Area 420 of flow cell 400 can be recessed such that the channels of separation channels 402, 404, 406, and 408 may be brought into closer proximity with a plate of a magnetic housing.

Figure 5:
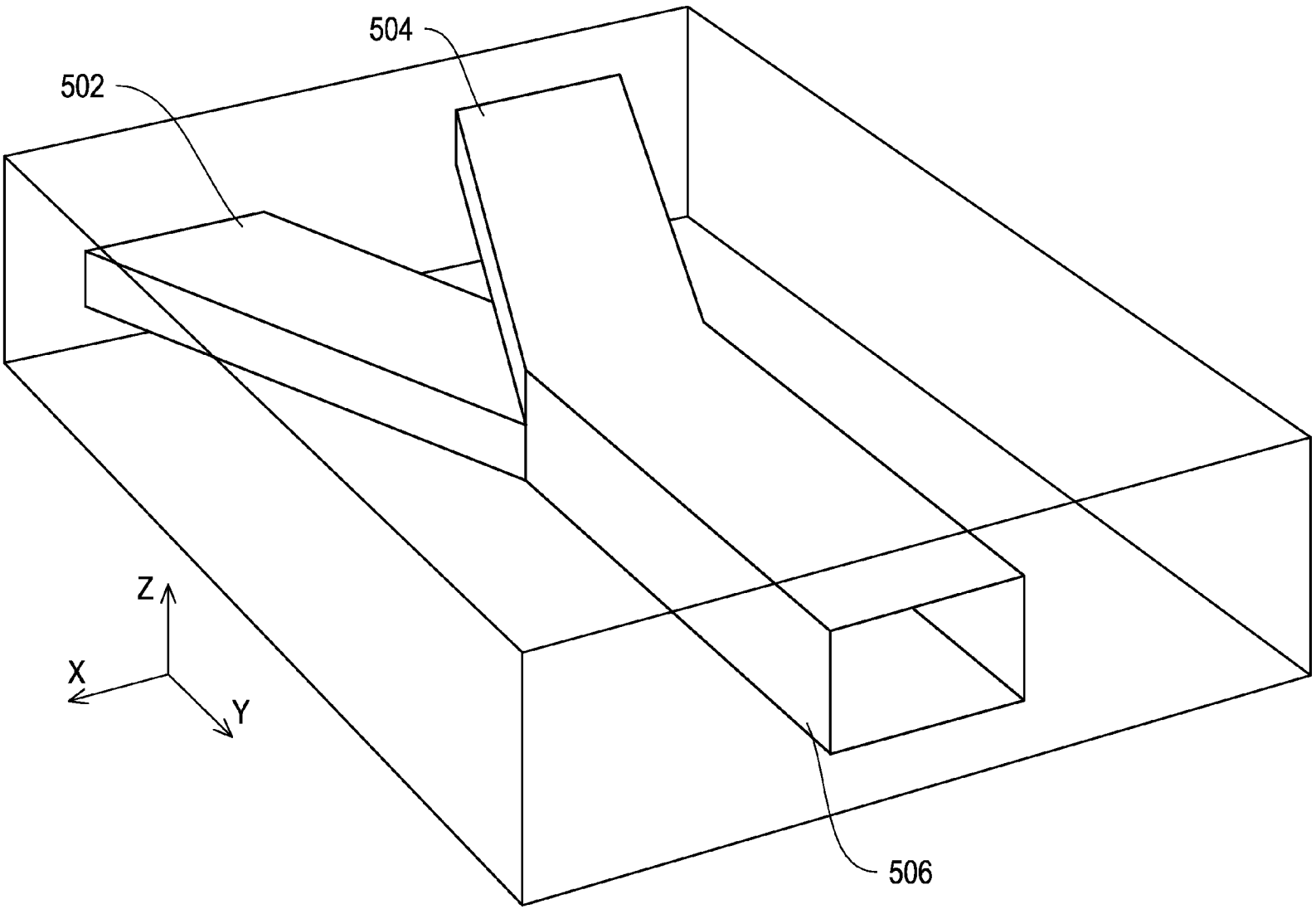
FIG. 5 is a schematic diagram illustrating a separation channel and the two inlets to the separation channel.

FIG. 5 is a schematic diagram illustrating a detail view of a separation channel and the two inlets to the separation channel. A sample fluid stream is flowed from sample channel 502 into separation channel 506. A buffer fluid stream is flowed from buffer channel 504 into separation channel 506. The sample fluid stream and buffer fluid stream flow in laminar flow through separation channel 506. Sample channel 502 and buffer channel 504 are depicted merging at an acute angle. The two channels may merge at a greater or lesser angle without departing from the spirit of the present invention, though merging the two fluids at high angle may result in undesirable flow through separation channel 506. In contrast, merging the two fluids at a lower angle may result in less rotation of the fluid interface as the two fluids flow through channel 506. In other embodiments, the sigmoidal interface may be eliminated by fabricating the flow cell with a barrier layer as described below for FIG. 13. In one embodiment, the separation channel 506 and the channels that connect to it, for example, the sample channel 502, buffer channel 504, and outlet channels have cross-sections that are circular, oval, or of other shape without sharp corners, to enable smooth flow of blood through the device. In one embodiment, the intersections or bifurcations between these channels have smooth rounded transitions to avoid any sharp corners, features or sudden expansions or contractions at these junctions.

Figure 6:
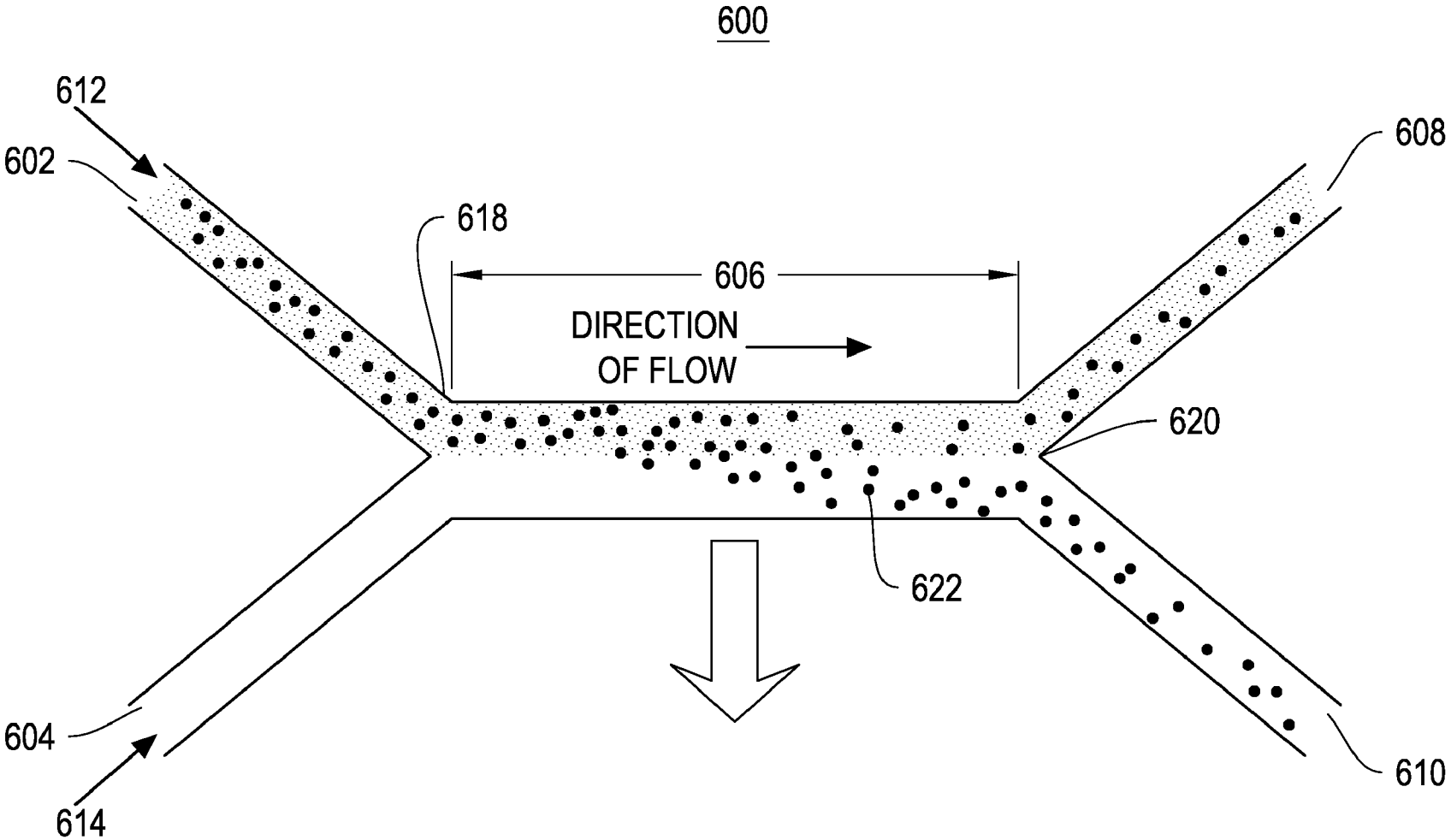
FIG. 6 is a schematic diagram illustrating the trajectory of target particles in the invention subject to pressure driven flow and a transverse magnetic field gradient.

FIG. 6 is a schematic diagram illustrating the trajectory of target particles in the invention subject to pressure driven flow and a transverse magnetic field gradient. The device 600 includes a sample inlet 602, a buffer inlet 604, a separation channel 606, a sample outlet 608, and a buffer outlet 610.

The inlets 602 and 604 are positioned to introduce two fluid streams into the separation channel 606 in laminar flow. The sample inlet 602 introduces sample fluid stream 612 which includes target particles. The buffer inlet 604 introduces buffer fluid stream 614.

The width and depth of the flow channel 606 are selected to allow the fluid streams from inlets 602 and 604 to be in laminar flow through the separation channel 606. The width of flow channel 606 can be between 0.1 mm and 1 mm, for example 0.5 mm wide. The height of flow channel 606 can be between 50 μm and 500 μm, for example 100 μm tall. The length of separation channel 606 is selected to be sufficiently long to allow target particles to have sufficient time to diffuse from one wall 618 of the separation channel across the interface 620 of fluid streams 612 and 614. For example, in one embodiment, the channel is about 2 cm long, though shorter or longer separation channels may also be suitable.

A magnetic housing, discussed above in relation to FIGS. 1 and 2, establishes a magnetic field gradient perpendicular to the flow of the fluids through the separation channel. As sample fluid stream 612 and buffer fluid stream 614 flow through separation channel 606, the magnetic field gradient causes particles to move across interface 620 of the two fluid streams. The strength of the magnetic field gradient is selected based upon the susceptibility of the target particle. For example, in various embodiments, the field strength can be between about 100 T/m to about 480 T/m.

Preferably, sample fluid stream 612 includes target particles bound to magnetic or paramagnetic nanoparticles or microparticles, (e.g., paramagnetic beads coupled to antibodies selected to bind to the target particles) to enhance the magnetic susceptibility of the target particles. In some embodiments, bio-functionalized magnetic nanoparticles or microparticles are bound to, or adsorbed by the target particles prior to being flowed through device 600.

At the downstream end of separation channel 606 are sample outlet 608 and buffer outlet 610. Sample outlet 608 collects most of sample fluid stream 612. Buffer outlet 610 collects most of buffer fluid stream 614, as well as target particles, such as target particle 622, which have been moved across interface 620 of fluid streams 612 and 614.

Figure 7A:
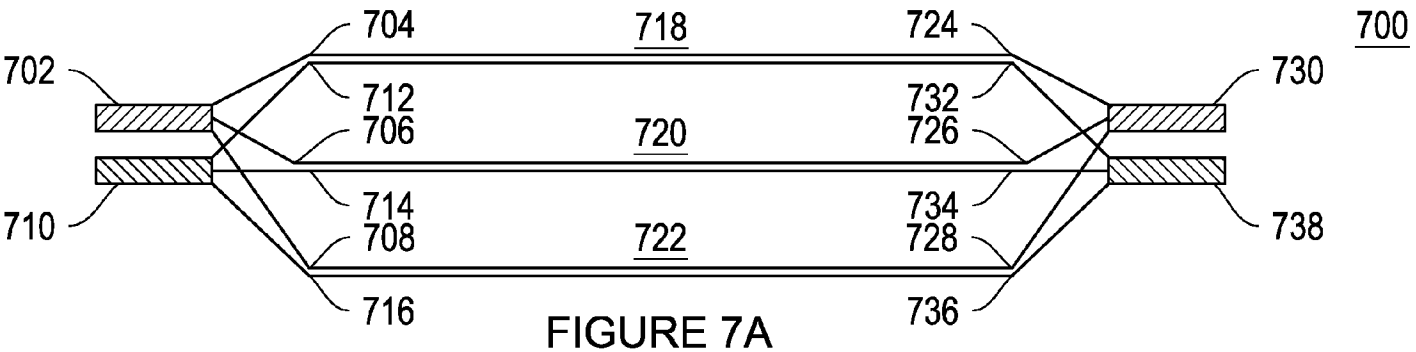
FIGS. 7A and 7B are schematic diagrams of top-views of parallel arrays of separation channels with a fluid network for distributing a fluid stream to a plurality of separation channels and a fluid network for combining a plurality of fluid streams into a single fluid stream.

FIG. 7A is a schematic diagram of top-view of a parallel array 700 of separation channels with a fluid network for distributing a fluid stream to a plurality of separation channels and a fluid network for combining a plurality of fluid streams into a single fluid stream. A sample fluid stream entering sample input port 702 is split into three streams going to sample inlets 704, 706, and 708 of separation channels 718, 720, and 722, respectively. A buffer fluid stream entering sample input port 710 is split into three streams going to buffer inlets 712, 714, and 716 of separation channels 718, 720, and 722, respectively. At the ends of separation channels 718, 720, and 722, the sample fluid stream is collected at sample outlets 724, 726, and 728, respectively, and combined into sample output port 730. Simultaneously, at the ends of separation channels 718, 720, and 722, the buffer fluid stream is collected at buffer outlets 732, 734, and 736, respectively, and combined into buffer output port 738.

Figure 7B:
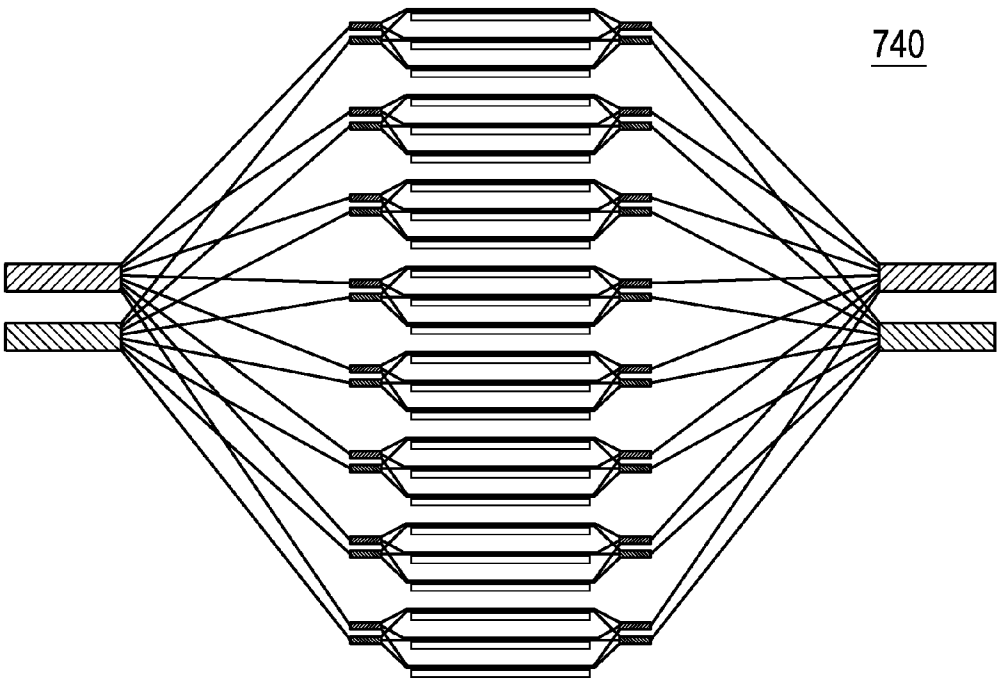

FIG. 7B is a schematic diagram of a top-view of a parallel array 740 of devices such as device 700, depicted in FIG. 7A, with a fluid network for distributing a fluid stream to a plurality of separation channels and a fluid network for combining a plurality of fluid streams into a single fluid stream. This embodiment operates like device 700, but where the fluid network of device 700 distributes fluid streams to three separation channels, the fluid network of this embodiment distributes fluid streams to the inlets of twenty-four separation channels. Likewise, the fluid network combines fluid streams from the outlets of 24 separation channels into a single output stream. Although array 740 is depicted with twenty-four separation channels, other embodiments of the present invention can incorporate additional separation channels, for example 200 separation channels.

Figure 8A:
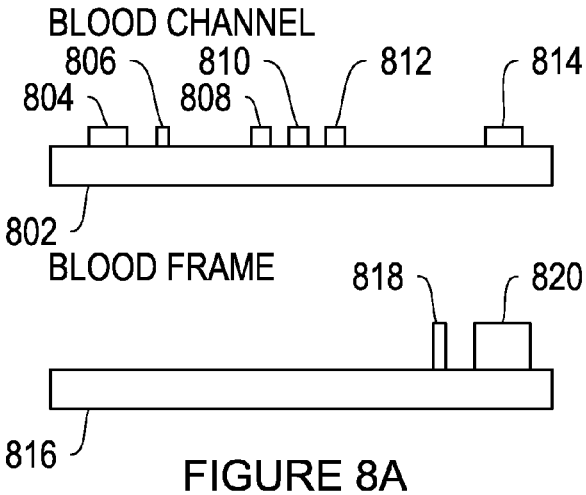
FIGS. 8A through 8F are schematic diagrams illustrating a manufacturing process for making the flow cell depicted in FIG. 1.
Figure 8D:
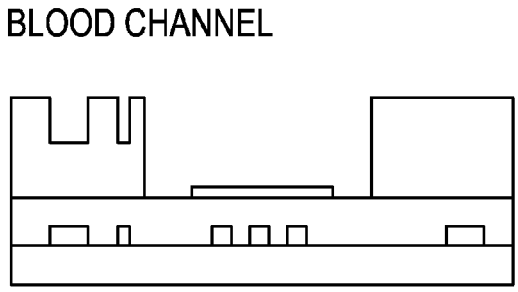
Figure 8B:
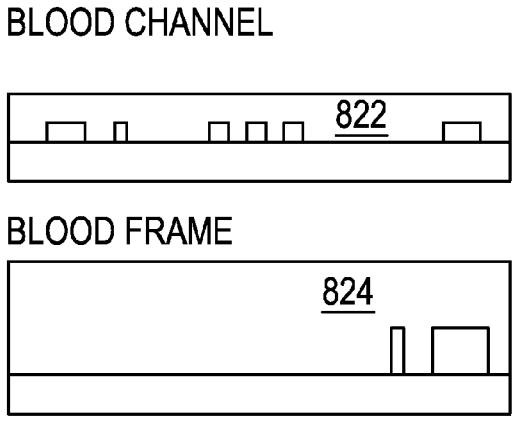

FIGS. 8A through 8F are schematic diagrams illustrating a manufacturing process for making the flow cell depicted in FIG. 1. FIG. 8A depicts a cross-section of a first substrate 802 with surface features 804, 806, 808, 810, 812, and 814. Surface features 804, 806, 808, 810, 812, 814, 818, and 820 are "mold masters" and may be microfabricated using standard methods, for example using SU-8 photopolymer on a silicon substrate, such as substrate 802 and 816. Then multiple polymer devices are molded from the masters, as depicted in FIGS. 8B through 8F. To form the polymer devices, a dam is created around the edge of substrates 802 and 816. A liquid polymer, such as PDMS, is disposed atop the wafer to the desired depth, as depicted in FIG. 8B. Surface features 804 and 814 will create space which will later be used to add structural rigidity to the device. Surface features 806 and 818 will create space which will later be used for aligning two halves of a flow cell to form a flow cell. Surface features 808, 810, and 812, will create space which will later form separation channels in the finished flow cell.

FIG. 8B depicts substrate 802 after polymer layer 822 has been disposed atop substrate 802 and polymer layer 824 has been disposed atop substrate 816. Polymer layers 822 and 824 are thick enough to cover surface features 804, 806, 808, 810, 812, and 814. The polymer is then cured. Once the polymer is cured, the damn around the edge of the substrate may be removed. Then the substrate itself may be separated from the polymer device, leaving just the polymer device, as depicted in FIG. 8C.

Figure 8E:
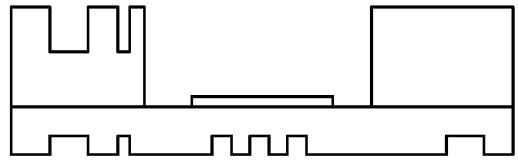
Figure 8C:
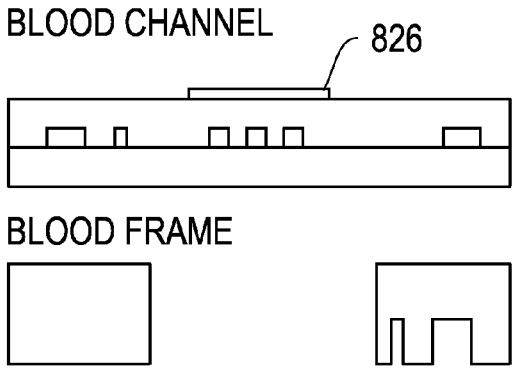

FIG. 8C depicts polymer layer 824 after substrate 816 has been removed. Polymer layer 824 features an empty area in the center. Polymer layer 824 is depicted as two disconnected pieces. At this cross-section of the device, the two appear disconnected because polymer layer 824 includes a recessed rectangular area, as depicted for flow cell 102 of FIG. 1. At other cross-sections, for example near the ends of the device, Polymer layer 824 would appear as a single solid rectangle of polymer. FIG. 8C also depicts polymer layer 822 still affixed to substrate 802. In addition, support 826 is affixed to polymer layer 822. Once polymer layer 824 is separated from substrate 816, it is inverted and aligned above polymer layer 822. Once the layers are properly aligned with respect to each other, they are brought into contact as depicted in FIG. 8D.

FIG. 8D depicts polymer layer 824 inverted and affixed to polymer layer 822. Polymer layers 822 and 824 can be affixed in a variety of ways, such as by adhesive or by exposure to ionized oxygen to chemically bond polymer layer 822 to polymer layer 824. Once the polymer layers 822 and 824 are bonded, polymer layer 822 is separated from substrate 802 as depicted in FIG. 8E.

Figure 8F:
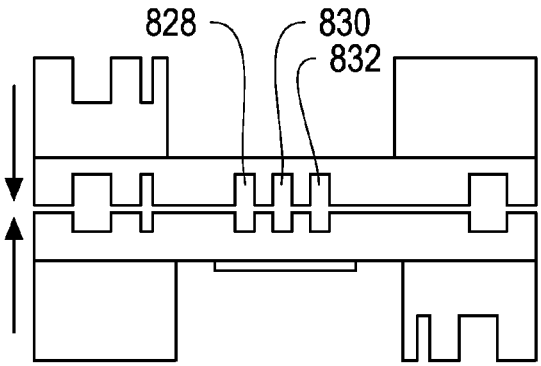

FIG. 8E depicts polymer layers 824 and 822 after bonding. Polymer layer 822 has been separated from substrate 802. Once substrate 802 is removed, the remaining device forms one-half of a flow cell. Steps 8A through 8E are then repeated to form another half of a flow cell. The two halves are then aligned, brought into contact, and bonded, for example by adhesive or by exposure to ionized oxygen. Separation channels 828, 830, and 832 are visible in cross-section. The resulting flow cell is depicted in FIG. 8F.

FIGS. 9A through 9H are schematic diagrams illustrating alternative embodiments for the shape of the plate and the stage of a magnetic housing. The various geometries depicted in FIGS. 9A through 9H each focus the magnetic field gradient across the separation channels of the flow cell in different ways. One of the geometries may be better suited to a particular application than other geometries. By providing a removable plate, the magnetic housing of the present invention allows a user to select a particular geometry for a particular application. In the preferred embodiment, the plate is made of extremely high permeability and high saturation (>1 Tesla) magnetic alloys, such as mu-metal.

Figure 9A:
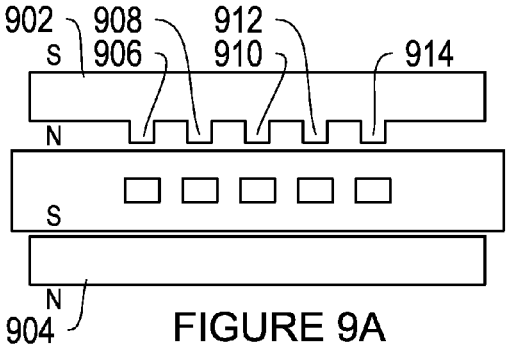
FIGS. 9A through 9H are schematic diagrams illustrating alternative embodiments for the shape of the first and second magnetic surfaces of a magnetic housing.

In FIG. 9A, plate 902 has rectangular ridges 906, 908, 910, 912, 914 and stage 904 has a flat featureless surface.

Figure 9B:
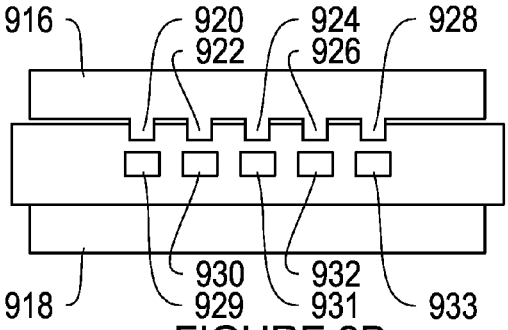

In FIG. 9B, plate 906 has rectangular ridges 920, 922, 924, 926, 928 and stage 908 has a flat featureless surface. Unlike FIG. 9A, ridges 920, 922, 924, 926, and 928 extend below the top surface of the flow cell, thereby reducing the distance from separation channels 929, 930, 931, 932, and 933, respectively.

Figure 9C:
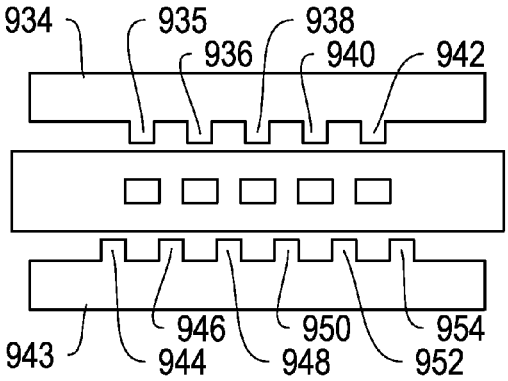

In FIG. 9C, plate 934 has rectangular ridges 935, 936, 938, 940, and 942, and stage 943 has rectangular ridges 944, 946, 948, 950, 952, and 954. The ridges of plate 934 are in a staggered position relative to the ridges of plate 943.

Figure 9D:
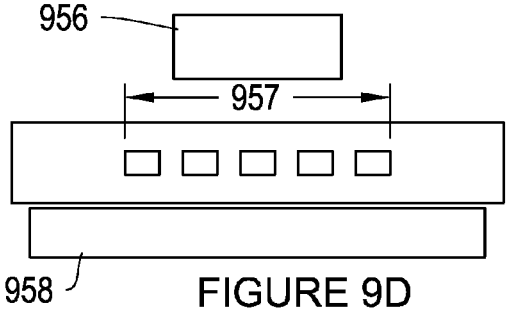

In FIG. 9D, the width of plate 956 is less than the width of the array of separation channels 957. Plate 956 has a flat surface. Stage 958 is wider than the array of separation channels and has a flat surface.

Figure 9E:
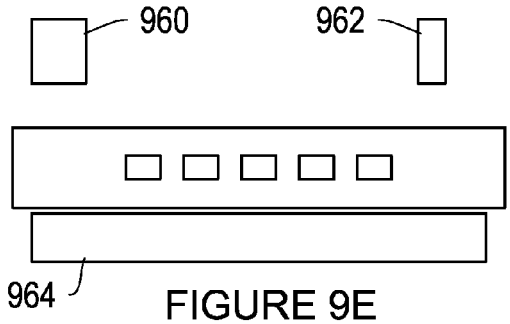

In FIG. 9E, the plate included left surface 960 and right surface 962. Both surface 960 and surface 962 have flat faces. Stage 964 also has a flat surface.

Figure 9F:
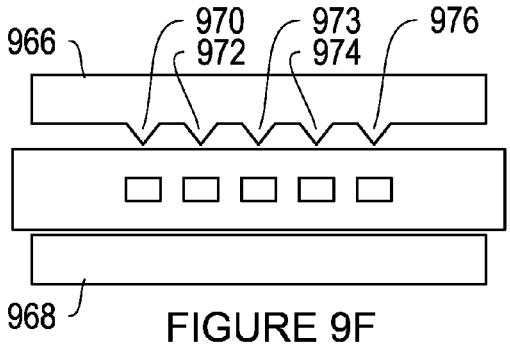

In FIG. 9F, plate 966 includes triangular ridges 970, 972, 973, 974, and 976. Plate 966 includes an area of flat surface separating these ridges. Stage 968 has a flat surface.

Figure 9G:
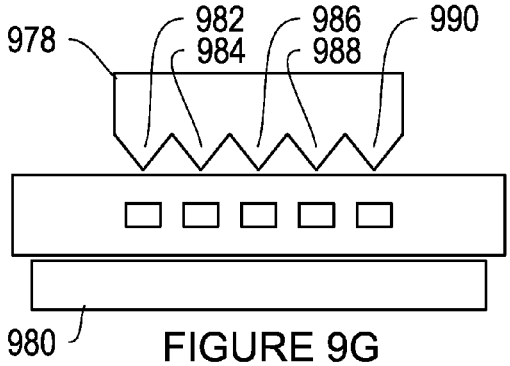

In FIG. 9G, plate 978 includes triangular ridges 982, 984, 986, 988, and 990. Plate 978 does not include any flat space between triangular ridges 982, 984, 986, 988, and 990. Stage 980 has a flat surface.

Figure 9H:
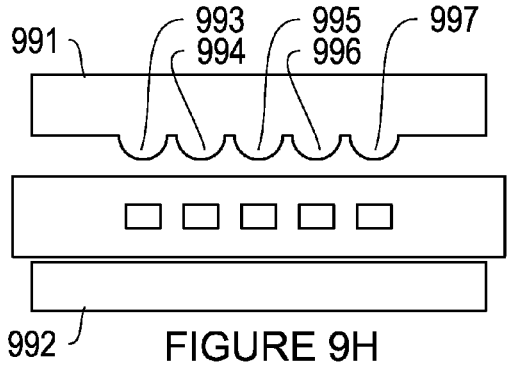

In FIG. 9H, plate 991 includes convex ridges 993, 994, 995, 996, and 997. Plate 991 includes an area of flat surface separating these ridges. Stage 992 has a flat surface.

Figure 10:
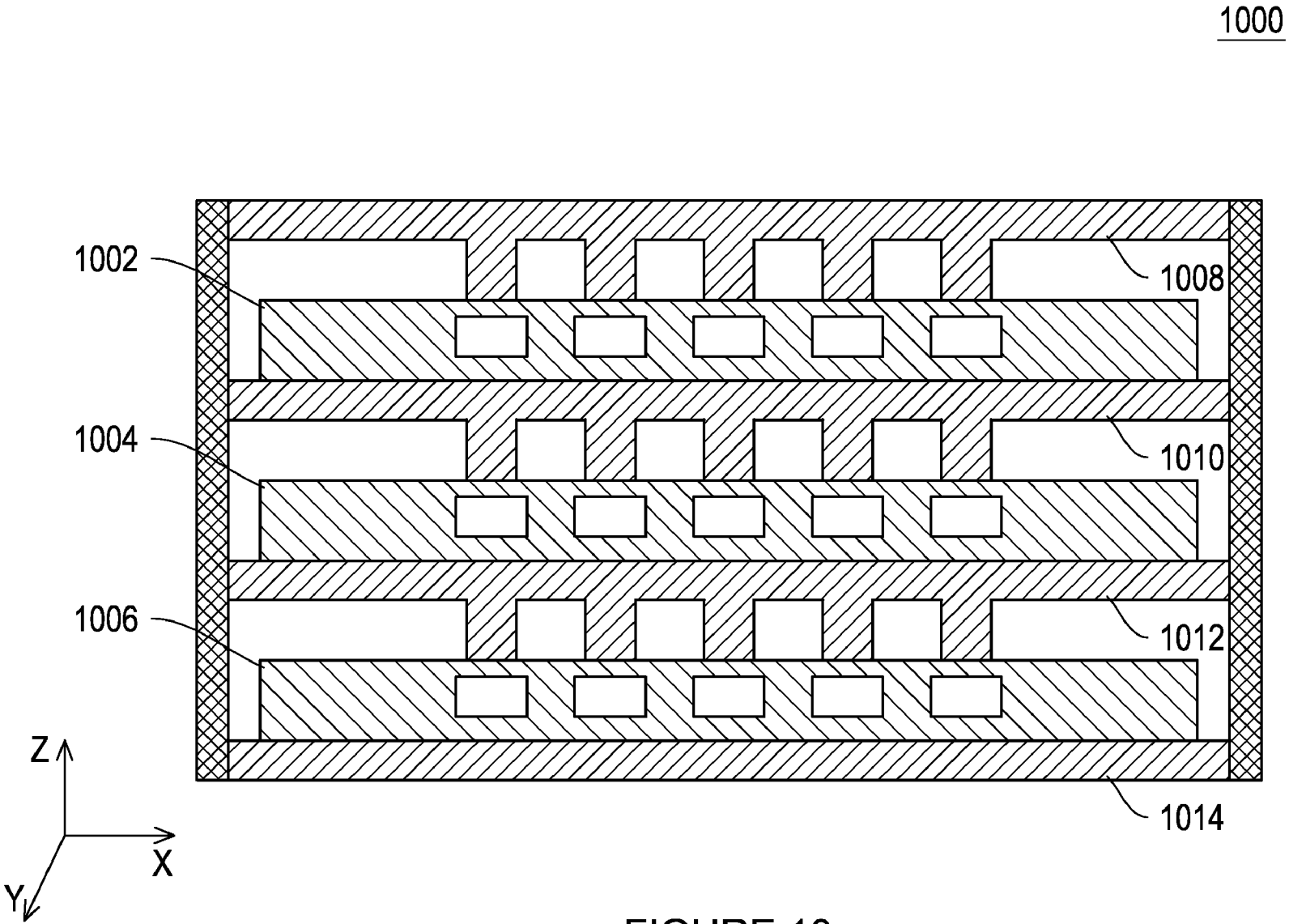
FIG. 10 is a schematic diagram illustrating a cartridge of flow cells, wherein a plurality of flow cells are arranged in the Z-direction.

FIG. 10 is a schematic diagram illustrating a cartridge 1000 of flow cells suitable for use with magnetic housings 104 or 204 of FIGS. 1 and 2, wherein a plurality of flow cells are arranged in the Z-direction. The Z-direction corresponds to the predominant direction of the magnetic field gradient created by the magnetic housings 104 or 204. In such an embodiment, throughput is improved by using multiple flow cells in parallel. Cartridge 1000 is a reusable frame for holding a plurality of flow cells. Cartridge 1000 includes several permeable metal structures, for example structures 110 and 112 which serve as stages for flow cells above them and plates for flow cells beneath them. The plate side of each structure 1010 and 1012 are shaped to concentrate the magnetic field gradient across respective separation channels placed beneath them. These structures are not connected on the sides by permeable metal. They may be connected as needed for structural purposes with a low permeability material, such as plastic. Cartridge 1000 can be made of any permeable metal, but is made of high-permeability metal in the preferred embodiment. Flow cell 1002 is interleaved between structure 1008 and second structure 1010. Flow cell 1004 is interleaved between second structure 1010 and third structure 1012. Flow cell 1006 is interleaved between third structure 1012 and fourth structure 1014. Flow cells 1002, 1004, and 1006 can be inserted into and removed from cartridge 1000. Flow cells 1002, 1004, and 1006 can be disposable. Flow cells 1002, 1004, and 1006 each have their own input ports and output ports. Cartridge 1000 can be positioned in a magnetic housing, for example magnetic housing 104, discussed above in reference to FIG. 1, or magnetic housing 1100, as discussed below with reference to FIG. 11A.

Figure 11A:
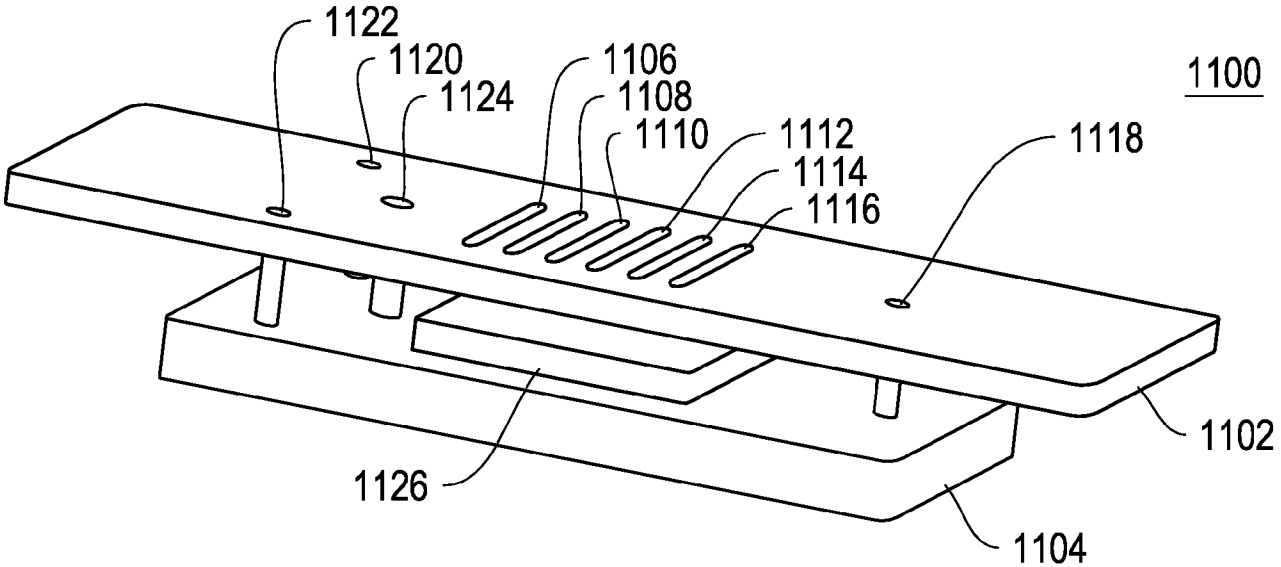
FIGS. 11A and 11B are prospective and cross-section schematic diagrams, respectively, of an alternative embodiment of a magnetic housing.
Figure 11B:
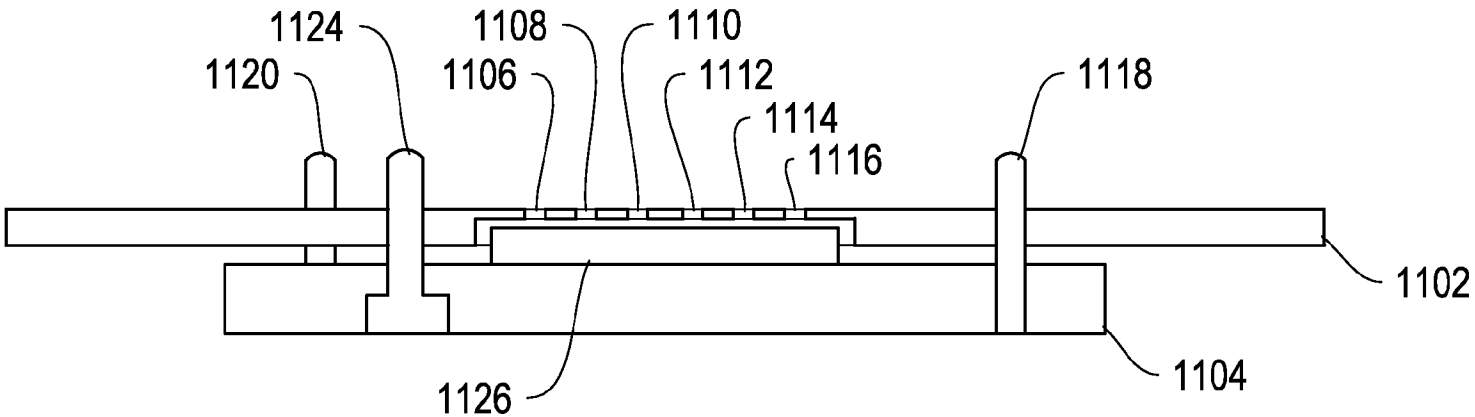

FIGS. 11A and 11B are prospective and cross-section schematic diagrams, respectively, of a magnetic housing 1100. Magnetic housing 1100 includes a plate 1102 and a back plate 1104. Unlike the embodiment illustrated in FIGS. 1 and 2, the embodiment depicted in FIG. 11A is not a C-shaped magnet or electromagnet. Instead, a flow cell may be placed upon plate 1102. The flow cell may be positioned on riser 1126 or, preferably, on the outer face of plate 1102. In this configuration, the entire assembly can be placed under an optical instrument, such as a microscope objective, for observation or detection of separation performance. Permanent magnets 1106, 1108, 1110, 1112, 1114, and 1116 create the magnetic field gradient across the separation channels of the flow cell (not depicted). The predominant direction of the magnetic field gradient is perpendicular to the direction of fluid flow through the flow cell. Permanent magnets 1106, 1108, 1110, 1112, 1114, and 1116 are embedded in plate 1102. Plate 1102 and back plate 1104 do not include ridges to focus the magnetic field gradient. Although FIG. 11B is illustrated with six permanent magnets, more or fewer magnets may also be suitable.

Magnetic housing 1100 includes alignment pins 1118, 1120, and 1122 for aligning plate 1102 and back plate 1104. Magnetic housing 1100 includes adjustment screw 1124 for adjusting the distance between plate 1102 and back plate 1104. The strength of the magnetic field gradient across the flow cell may be decreased by increasing the distance between the plate 1102 and back plate 1104, or may be increased by decreasing the distance between plate 1102 and back plate 1104.

FIG. 11B is a schematic diagram of a cross-section view of the embodiment depicted in FIG. 11A. Plate 1102 includes a riser 1126 for positioning a flow cell in close proximity to permanent magnets 1106, 1108, 1110, 1112, 1114, and 1116.

Figure 12:
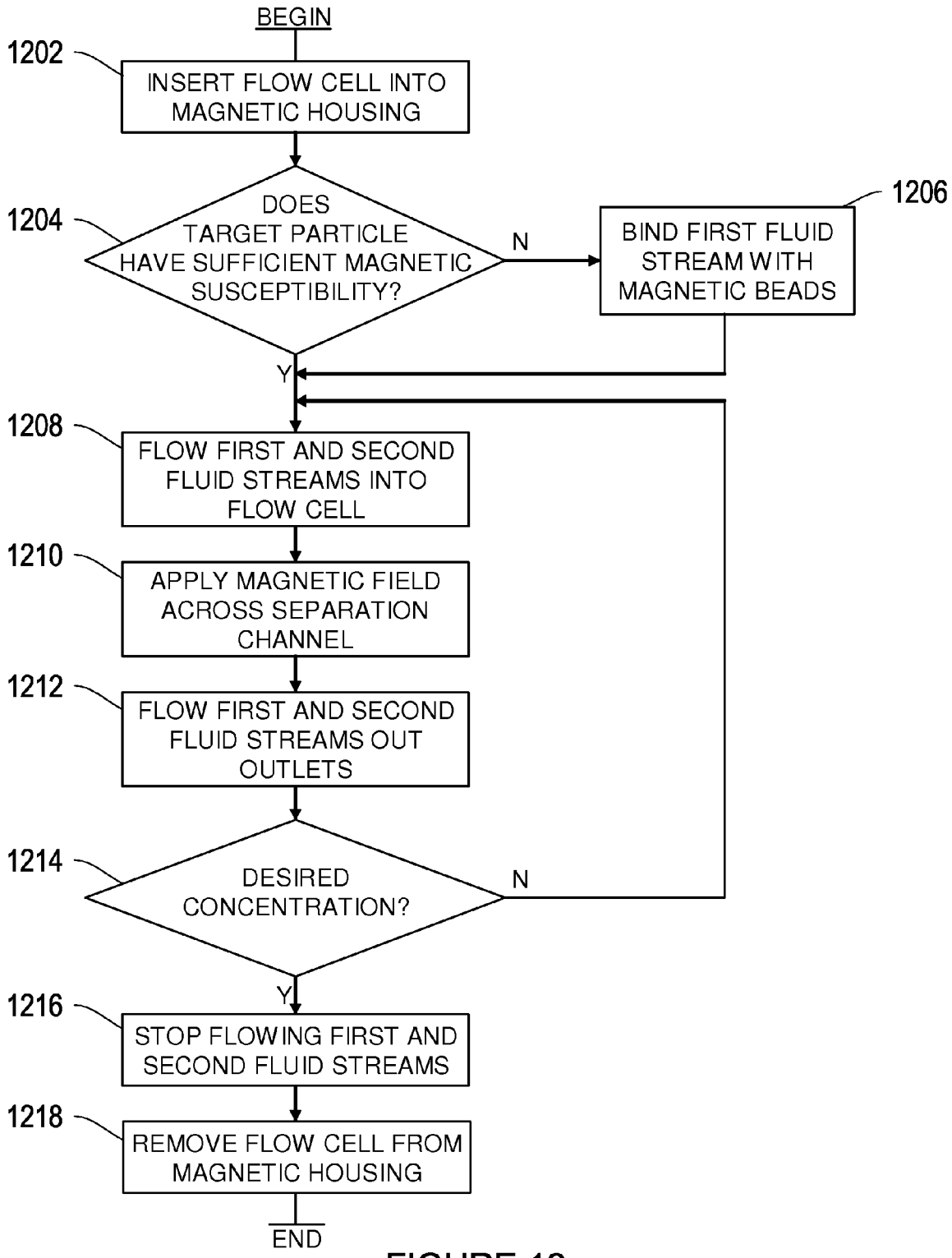
FIG. 12 is a flowchart showing a method for separating particles, cells, or molecules from an aqueous solution using illustrative embodiments of this invention.

FIG. 12 is a flowchart showing a method for separating particles, cells, or molecules from an aqueous solution using illustrative embodiments of this invention. The separation process includes inserting a flow cell into a magnetic housing (step 1202), determining whether the target particle has sufficient magnetic susceptibility in the first fluid stream (step 1204) and, if not, mixing the first fluid stream with magnetic beads in order to bind magnetic beads to the target particles to improve the magnetic susceptibility of the target particles (step 1206). Next, the sample fluid stream and buffer fluid stream are flowed through the flow cell (step 1208), flowing the fluid streams through a magnetic field gradient transverse to the direction of fluid flow (step 1210), and flowing the sample fluid stream and buffer fluid stream out first and second outlets, respectively, at the downstream end of the separation channel (step 1212). In some embodiments, the sample fluid stream is introduced into the flow cell at a higher, the same, or a lower flow rate than the buffer fluid stream. Steps 1208 through 1212 are repeated until the sample fluid stream has the desired concentration of target particles (step 1214). Once the desired concentration is reached, the two fluid streams are stopped (step 1216) and the flow cell can be removed from the magnetic housing (step 1218).

More specifically, a sample fluid containing particles, cells, or molecules is flowed into a flow cell comprising a plurality of separation channels. A buffer fluid, for collecting the target particles, is flowed into the plurality of separation channels in the flow cell. These streams are flowed at flow rates that maintain laminar flow within the separation channel.

As the fluid streams flow through the separation channel, they flow through a magnetic field gradient applied transverse to the direction of pressure-driven flow in the separation channel. The magnetic field gradient exerts a force on magnetically-susceptible particles, causing them to move in the direction of the buffer fluid stream. The magnetic field gradient strength must be sufficient to cause target particles to move into the buffer fluid stream. At the downstream end of the separation channel, the sample fluid stream is collected at a sample outlet. At the downstream end of the separation channel, the buffer fluid stream is collected at a buffer outlet. The sample fluid stream collected at the outlet has a lower concentration of target particles than it did at the inlet to the separation channel because target particles have migrated to the buffer fluid stream.

If the magnetic susceptibility of a target particle is insufficient to achieve desired rates of separation, or non-target particles may have approximately the same magnetic susceptibility as the target particle, a target particle may be made more responsive to the magnetic field gradient by binding it to a magnetic nanoparticle or microparticle. In such an embodiment, step 1202 may be preceded by mixing the sample fluid with functionalized magnetic nanoparticles or microparticles. The sample fluid, such as blood, is passed repeatedly through a microfluidic mixer, as is commonly known in the art, at a relatively slow rate (~1 ml/min) in order to promote optimal bead-pathogen binding. After being allowed to bind optimally to the particles in the mixer, a process which takes approximately 5 to 10 minutes, the sample fluid is allowed to pass through the flow cell where the sample fluid is cleared of most or all magnetic beads and bound pathogens before the sample fluid exits the flow cell.

Figure 13:
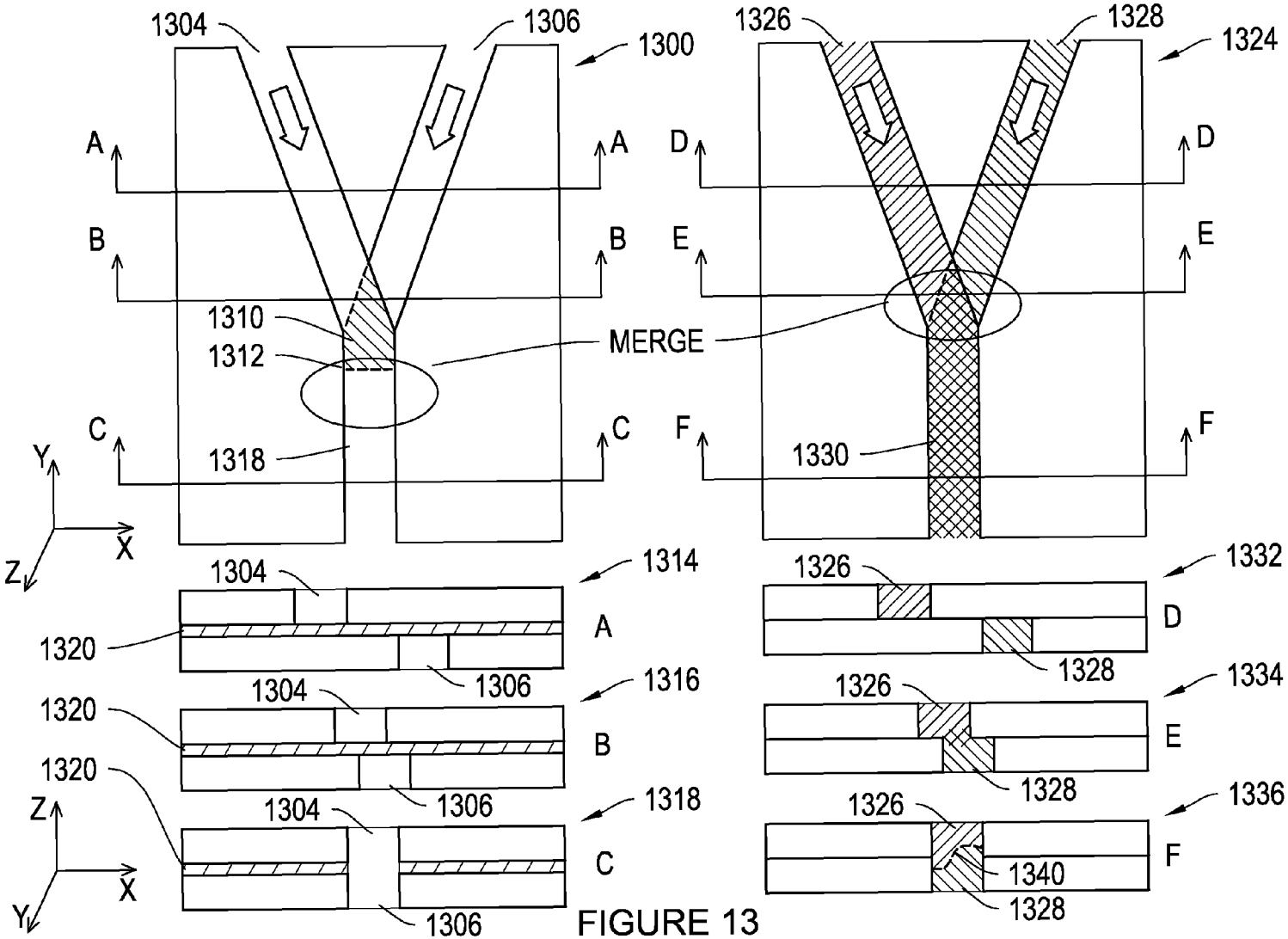
FIG. 13 is a schematic diagram comparing the top and three cross-sections of a flow cell with a barrier layer and a second flow cell without a barrier layer.

FIG. 13 is a schematic diagram comparing the top view and three cross-sections of a flow cell with a barrier layer and a second flow cell without a barrier layer. Flow cell 1300 is depicted from the top in the X-Y plane, and in cross-section in the X-Z plane at locations A, B, and C. Flow cell 1300 has first inlet 1304 and second inlet 1306. Inlets 1304 and 1306 merge to form separation channel 1318. Shaded area 1310 indicates where the channels overlap in the Z-direction, but the fluid stream flowing through first inlet 1304 is not in contact with the fluid stream flowing through second inlet 1306. Dashed line 1312 indicates the end of barrier layer 1320. At this location, the two fluid streams first come into contact. The cross section of flow cell 1300 in the X-Z plane at location A is depicted in cross section 1314. In cross section 1314, first inlet 1304 and second inlet 1306 do not overlap in the Z-direction. The cross section of flow cell 1300 in the X-Z plane at location B is depicted in cross section 1316. In cross-section 1314, first inlet 1304 overlaps partially with second inlet 1306 in the Z-direction, but the inlets are separated by barrier layer 1320. Barrier layer 1320 acts as a barrier between a fluid flowing through first inlet 1304 and a fluid flowing through 1306. The cross-section of flow cell 1300 in the X-Z plane at location C is depicted in cross-section 1318. In cross-section 1318, first inlet 1304 overlaps second inlet 1306 such that the inlets 1304 and 1306 are aligned in the Z-direction (the predominant direction of the magnetic field gradient) and the fluid streams flowing through both are flowing predominantly in the Y-direction. At location C, the two fluid streams are no longer separated by barrier layer 1320. Because barrier layer 1320 creates a barrier between the two fluid streams until their respective directions of flow are aligned, this embodiment reduces the lateral physical shear caused by merging the two fluid streams. In the embodiment described, fluid interface 1306 is less sigmoidal than in embodiments such as flow cell 1324.

Flow cell 1324 is depicted from the top in the X-Y plane, and in cross-section in the X-Z plane at locations D, E, and F. Flow cell 1324 has a first inlet 1326 and a second inlet 1328. Without a barrier layer to separate inlets 1326 and 1328 as they merge, the fluid stream flowing through first inlet 1326 comes into contact with the fluid stream flowing through second inlet 1328 before the respective directions of their flow are aligned, as depicted in cross-section 1334. In cross-section 1334, first inlet 1326 overlaps partially with second inlet 1328, and the fluid streams from the respective inlets come into contact with each other. As first inlet 1326 and second inlet 1328 merge to form the separation channel, the two fluids move in the X-direction with respect to each other, introducing a lateral physical shear between the two fluid streams. In such an embodiment, fluid interface 1340 has a sigmoidal shape, as described above with reference to FIG. 2, and depicted in cross-section 1336. A sigmoidal fluid interface may have adverse effects on the separation of particles from the first fluid stream, but these adverse effects can be addressed by addition of barrier layer 1320, as described above. In other embodiments, a sigmoidal interface may be preferred.

The invention may be embodied in other specific forms without departing form the spirit or essential characteristics thereof. The foregoing embodiments are therefore to be considered in all respects illustrative, rather than limiting of the invention.

What is claimed:

1. An apparatus comprising:

a microfluidic flow cell having an upstream end and a downstream end, the flow cell including:

a separation channel;

a first inlet at the upstream end to introduce a first fluid containing particles into the separation channel;

a second inlet at the upstream end to introduce a second fluid into the separation channel in laminar flow with the first fluid;

a first outlet at the downstream end for receiving the first fluid;

a second outlet at the downstream end for receiving the second fluid, wherein the first inlet and first outlet are formed in a first plane, and the second inlet and the second outlet are formed in a second plane parallel to the first plane;

a magnetic housing including:

a stage for positioning the microfluidic flow cell;

a plate positioned opposite the stage for applying a magnetic field gradient across the separation channel; and a magnetic source for creating the magnetic field gradient across the plate and the stage.

2. The apparatus of claim 1, wherein the first fluid and the second fluid are positioned relative to each other in the separation channel in the predominant direction of the magnetic field gradient.

3. The apparatus of claim 1, wherein the first fluid and second fluid remain separated until the first fluid and second fluid flow in the same direction.

4. The apparatus of claim 3, comprising a barrier to maintain the separation between the first fluid and the second fluid until the first fluid and the second fluid flow in the same direction.

5. The apparatus of claim 1, wherein the flow cell comprises a plurality of separation channels.

6. The apparatus of claim 5, wherein the separation channels are arrayed laterally with respect to one another across the flow cell, perpendicular to the direction of flow and perpendicular to the predominant direction of the magnetic field gradient.

7. The apparatus of claim 5, wherein the flow cell comprises a plurality of input ports and output ports.

8. The apparatus of claim 5, wherein the flow cell comprises:

a first input port at the upstream end to introduce the first fluid into a respective-first inlet of each of the separation channels;

a second input port at the upstream end to introduce the second fluid into a respective-second inlet of each of the separation channels;

a first output port at the downstream end for receiving the first fluid from the respective-first outlets of each of the separation channels; and a second output port at the downstream end for receiving the second fluid from the respective-second outlets of each of the separation channels.

9. The apparatus of claim 1, wherein walls of the separation channel of the flow cell include a bio-compatible coating.

10. The apparatus of claim 1, wherein the stage and plate are made of high magnetic permeability metal.

11. The apparatus of claim 1, wherein the surface of the first plate has a shape configured to concentrate the magnetic field gradient at or about the separation channels.

12. The apparatus of claim 1, wherein the separation channel has a cross-section that is circular, oval, or polygonal without sharp corners.

13. The apparatus of claim 1, wherein junctions between the first and second inlets and the separation channel have smooth, rounded transitions to avoid sharp corners, features, or sudden expansions or contractions at the junctions.

14. The apparatus of claim 1, wherein the stage is configured to position a plurality of flow cells stacked with respect to one another in the predominant direction of the magnetic field gradient.

15. The apparatus of claim 14, comprising a plurality of flow cells positioned on the stage.

16. The apparatus of claim 14 comprising a plurality of plates which separate each of the plurality of flow cells from adjacent flow cells.

17. The apparatus of claim 14, wherein each of the plurality of flow cells comprises a plurality of separation channels, and the surface each of the plurality of plates has a shape configured to concentrate the magnetic field gradient at or about each of the plurality of separation channels of each of the plurality of flow cells.

18. An apparatus comprising:

a microfluidic flow cell having an upstream end and a downstream end, the flow cell including:

a separation channel;

a first inlet at the upstream end to introduce a first fluid containing particles into the separation channel;

a second inlet at the upstream end to introduce a second fluid into the separation channel in laminar flow with the first fluid;

a first outlet at the downstream end for receiving the first fluid from the separation channel; and a second outlet at the downstream end for receiving the second fluid from the separation channel;

wherein the first inlet and first outlet are formed in a first plane, and the second inlet and the second outlet are formed in a second plane parallel to the first plane; and a magnetic housing including:

a stage for positioning the microfluidic flow cell;

a magnetic element positioned proximate to the separation channel the stage for applying a magnetic field gradient across the separation channel.

19. A method for separating particles from a fluid comprising:

inserting a flow cell into a magnetic housing;

flowing a first fluid containing particles into a separation channel included in of the flow cell;

flowing the second fluid into the separation channel in laminar flow with the first fluid;

applying a magnetic field gradient across the separation channel perpendicular to the direction of flow of the first fluid and the second fluid, whereby at least a portion of particles in the first fluid are caused to migrate into the second fluid;

flowing a portion of the first fluid from the separation channel through a first outlet placed to receive the first fluid;

flowing a portion of the second fluid from the separation channel through a second outlet placed to receive the second fluid, wherein the first inlet and second inlet are formed substantially in a first plane, and the second inlet and the second outlet are formed substantially in a second plane parallel to the first plane; and removing the flow cell from the magnetic housing.

20. The method of claim 19, wherein the flow cell comprises a plurality of separation channels, and wherein the plurality of separation channels are arrayed laterally with respect to one another across the flow cell, perpendicular to the direction of flow and perpendicular to the predominant direction of the magnetic field gradient.

21. The method of claim 20, comprising coupling paramagnetic particles to the particles in the first fluid prior to flowing the first fluid into at least one of the plurality of separation channels.

22. The method of claim 20, comprising flowing the first fluid into at least one of the separation channels at a different rate from the second fluid.

23. The method of claim 19, wherein the first fluid is blood.

24. The apparatus of claim 1, wherein the magnetic source is generally C-shaped and comprises a first portion and a second portion, wherein the end of the first portion is coupled to the stage and the end of the second portion is coupled to the plate.

25. The apparatus of claim 24, wherein the magnetic housing includes a shim positioned between the uncoupled ends of the first and second portions of the magnetic source, wherein the thickness of the shim can be adjusted to adjust the strength of the magnetic field gradient across the stage and the plate.

26. The apparatus of claim 11, wherein the shape of the surface of the plate includes rectangular, rounded, or prismatic protrusions spaced to align with each of the plurality of separation channels.

27. The apparatus of claim 16, wherein the plurality of plates are made of a magnetically permeable material that concentrate the magnetic field gradient across the plurality of flow cells.

28. The method of claim 19, wherein the magnetic housing includes:

a stage for positioning the flow cell;

a plate positioned opposite the stage for applying the magnetic field gradient across the separation channel; and a magnetic source for creating the magnetic field gradient across the plate and the stage.

29. The method of claim 28, wherein the magnetic source is generally C-shaped and comprises a first portion and a second portion, wherein the end of the first portion is coupled to the stage and the end of the second portion is coupled to the plate.

30. The method of claim 29, wherein the magnetic housing includes a shim positioned between the uncoupled ends of the first and second portions of the magnetic source, wherein the thickness of the shim can be adjusted to adjust the strength of the magnetic field gradient across the stage and the plate.

* * * * *